US005588826A

United States Patent [19]

Döbbeling et al.

[11] Patent Number: 5,588,826

[45] Date of Patent: Dec. 31, 1996

[54] BURNER

[75] Inventors: Klaus Döbbeling, Windisch; Jürgen Haumann, Rekingen; Hans P. Knöpfel, Besenbüren; Bettina Paikert, Oberrohrdorf; Thomas Ruck, Mellingen; Thomas Sattelamayer, Mandach; Christian Steinbach, Neuenhof, all of Switzerland

[73] Assignee: ABB Management AG, Baden, Switzerland

[21] Appl. No.: 510,659

[22] Filed: Aug. 3, 1995

[30] Foreign Application Priority Data

Oct. 1, 1994 [DE] Germany ..... 44 35 266.2

[51] Int. Cl.[6] ..... F23D 14/62

[52] U.S. Cl. ..... 431/354; 431/351; 431/183; 239/402

[58] Field of Search ..... 431/2, 8, 9, 10, 431/183, 185, 351–354; 239/402

[56] References Cited

U.S. PATENT DOCUMENTS

| | | | |
|---|---|---|---|
| 1,778,194 | 10/1930 | Kreager | 239/402 |
| 3,853,273 | 12/1974 | Bahr et al. | 239/402 |
| 3,859,786 | 1/1975 | Azelborn et al. | 431/353 |
| 4,561,841 | 12/1985 | Korenyi | 431/351 |
| 5,193,995 | 3/1993 | Keller et al. | 431/351 |

FOREIGN PATENT DOCUMENTS

| | | |
|---|---|---|
| 0321809A1 | 6/1989 | European Pat. Off. . |
| 0433790A1 | 6/1991 | European Pat. Off. . |
| 2460709C2 | 12/1982 | Germany . |
| 28410 | 12/1907 | Sweden . |

*Primary Examiner*—James C. Yeung
*Attorney, Agent, or Firm*—Burns, Doane, Swecker & Mathis

[57] ABSTRACT

In a burner which consists of a swirl generator (100) on the oncoming-flow side, the flow (40) formed herein is passed smoothly into a mixing section (220). This is done with the aid of a transition geometry which is present at the start of the mixing tube (220) and consists of transition passages (201) which cover sectors of the end face of the mixing section (220), in accordance with the number of sectional bodies of the swirl generator (100), and run helically in the direction of flow. On the outflow side of these transition passages (201), prefilming bores (21) pass through the mixing section (220), which prefilming bores (21) initiate an increase in the flow velocity along the tube wall. Adjoining the mixing section (220) is a combustion chamber (30) in which a backflow zone (50) forms in the region of the jump in cross-section between mixing section (220) and combustion chamber (30).

18 Claims, 4 Drawing Sheets

100
115
201
200
10
220
40
20
21
31
50
30

BURNER

BACKGROUND OF THE INVENTION

1. Field of the Invention

The present invention relates to a burner having a swirl generator and mixing tube.

2. Discussion of Background

A conical burner consisting of several shells, a so-called double-cone burner, for generating a closed swirl flow in the cone head has been disclosed by U.S. Pat. No. 4,932,861 to Keller et al. In this type of burner, the swirl flow becomes unstable on account of the increasing swirl along the axis of the cone and changes into an annular swirl flow with backflow in the core. Fuels, for example, gaseous fuels, are injected along the ducts, also called air-inlet slots, formed by the adjacent edges of the individual adjacent shells and are mixed homogeneously with the air before the combustion occurs by ignition at the stagnation point of the backflow zone or backflow bubble, which is utilized as a flame retention baffle. Liquid fuels are preferably injected via a central nozzle at the burner head and then vaporize in the conical hollow space. Under typical gas-turbine conditions, the ignition of these liquid fuels occurs early near the fuel nozzle, whereby a sharp increase in the NOx values precisely on account of this lack of premixing cannot be avoided, which necessitates, for example, the injection of water. Furthermore, it was found that the attempt to burn hydrogenous gases similar to natural gas led to problems of premature ignition at the gas bores with subsequent overheating of the burner. An attempt has been made to remedy this by a special injection method for such gaseous fuels being introduced at the burner outlet, the results of which, however, have not been completely satisfactory.

SUMMARY OF THE INVENTION

Accordingly, one object of the invention, as defined in the claims, in a burner of the type mentioned at the beginning, is to propose measures by means of which perfect premixing of fuels of various types is achieved.

The proposed burner has a swirl generator on the head side and upstream of a mixing section. The swirl generator can preferably be designed to utilize the basic aerodynamic principles of the so-called double-cone burner according to U.S. Pat. No. 4,932,861 to Ketter et al. However, the use of an axial or radial swirl generator is also possible in principle. The mixing section itself preferably consists of a tubular mixing element, called a mixing tube below, which permits perfect premixing of fuels of various types.

The flow from the swirl generator is directed smoothly into the mixing tube: this is done by a transition geometry which consists of transition passages which are recessed in the initial phase of this mixing tube and which pass the flow into the adjoining effective cross-section of flow of the mixing tube. This introduction of flow free of losses between swirl generator and mixing tube prevents the direct formation of a backflow zone at the outlet of the swirl generator.

The swirl intensity in the swirl generator is selected via its geometry in such a way that the vortex breakdown does not take place in the mixing tube but further downstream at the combustion-chamber inlet. The length of this-mixing tube is selected so that an adequate mixing quality for all types of fuel is obtained. If, for example, the swirl generator used is constructed according to the features of the double-cone burner, the swirl intensity results from the arrangement of the corresponding cone angle, the air-inlet slots and the number thereof.

In the mixing tube, the axial-velocity profile has a pronounced maximum on the axis and thereby prevents flashbacks in this region. The axial velocity decreases toward the wall. In order to also prevent flashbacks in this area, various measures are taken: on the one hand, for example, the overall velocity level can be raised through the use of a mixing tube having a sufficiently small diameter. Another possibility consists in only increasing the velocity in the outer region of the mixing tube by a small portion of the combustion air flowing into the mixing tube via an annular gap or through prefilming bores downstream of the transition passages.

A portion of the pressure loss possibly produced can be compensated for by attaching a diffuser to the end of the mixing tube.

The combustion chamber having a jump in cross-section adjoins the end of the mixing tube. A central backflow zone forms here, the properties of which are those of a flame retention baffle.

The generation of a stable backflow zone requires a sufficiently high swirl number in the tube. But if such a high swirl number is undesirable in the first place, stable backflow zones can be generated by feeding small, intensely swirled air quantities, 5–20% of the total air quantity, at the tube end.

In combination with the abovementioned jump in cross-section at the tube end, backflow zones of high spatial stability are obtained which are especially suitable for flame stabilization.

As far as the abovementioned transition passages for introducing the flow into the mixing tube from the swirl generator are concerned, it can be said that the path of these transition passages turns out to be spirally convergent or widening, in accordance with the effective adjoining cross-section of flow of the mixing tube.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
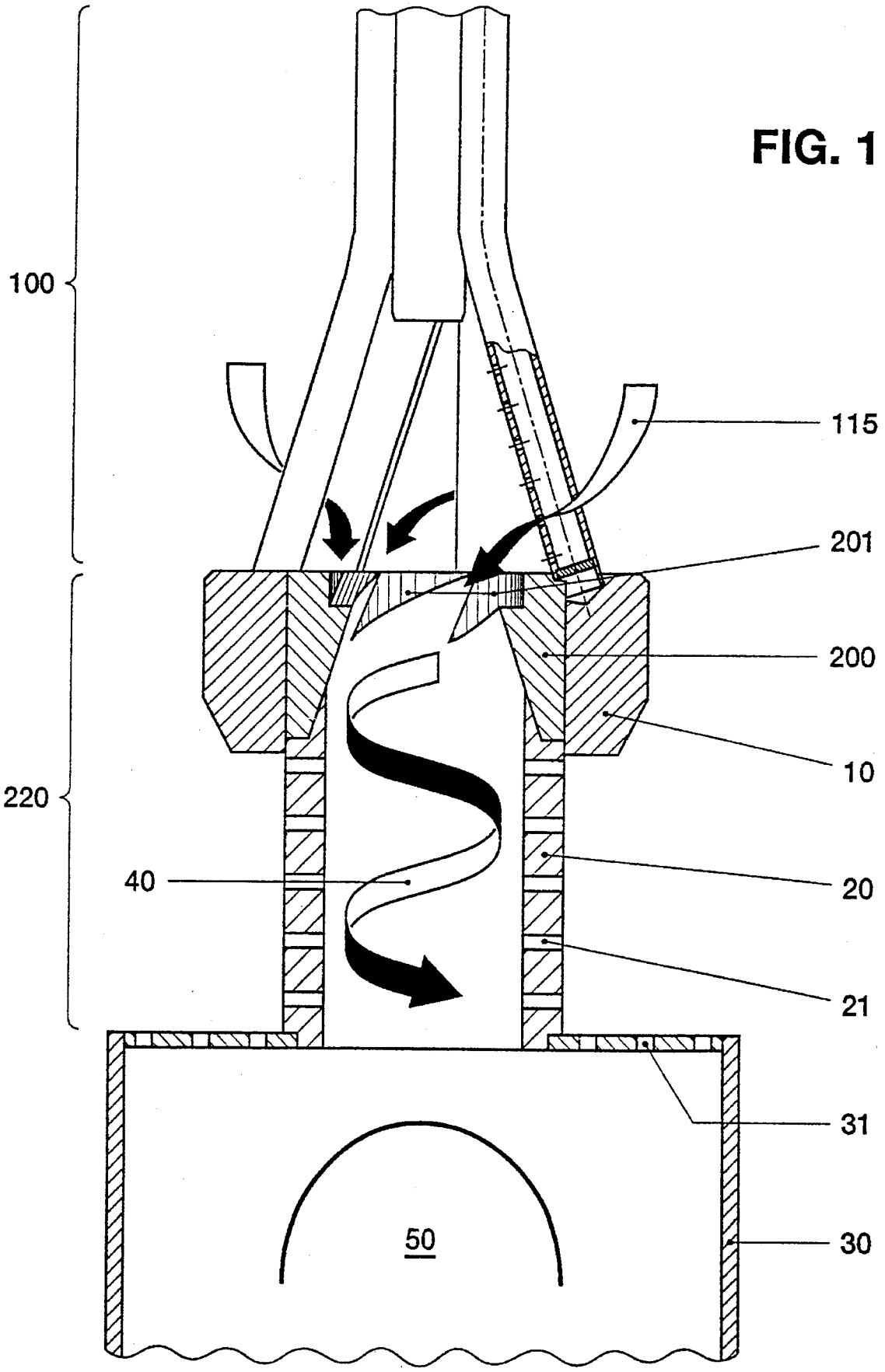
FIG. 1 shows a burner with adjoining combustion chamber.

Referring now to the drawings, wherein like reference numerals designate identical or corresponding parts throughout the several views, all features not essential for directly understanding the invention are omitted, and the direction of flow of the media is indicated by arrows, FIG. 1 shows the overall construction of a burner. The burner comprises swirl generator 100, the configuration of which is shown and described in more detail below in FIGS. 2 to 5. This swirl generator 100 is a conical structure which is repeatedly acted upon by a combustion-air flow 115 entering tangentially. The flow forming herein, with the aid of a transition geometry provided downstream of the swirl generator 100, is passed smoothly into a transition piece 200 in such a way that no separation regions can occur there. The configuration of this transition geometry is described in more detail under FIG. 6. This transition piece 200 is extended on the outflow side of the transition geometry by a tube 20, the transition piece 200 and the tube 20 forming the actual mixing tube 220 of the burner. The mixing tube 220 can of course be made in one piece, i.e. by the transition piece 200 and tube 20 being fused to form a single cohesive structure, the characteristics of each part being retained. If transition piece 200 and tube 20 are constructed from two parts, these parts are connected by a sleeve ring 10, the same sleeve ring 10 serving as an anchoring surface for the swirl generator 100 on the head side. In addition, such a sleeve ring 10 has the advantage that various mixing tubes can be used. Located on the outflow side of the tube 20 is the actual combustion chamber 30, which is symbolized here merely by the flame tube. The mixing tube 220 fulfils the condition that a defined mixing section be provided downstream of the swirl generator 100, in which mixing section perfect premixing of fuels of various types is achieved. Furthermore, the mixing tube 220 enables the flow to be guided free of losses so that in the first place no backflow zone can form even in interaction with the transition geometry, whereby the mixing quality for all types of fuel can be influenced over the length of the mixing tube 220. But this mixing tube 220 has another property, which is that in the mixing tube 220 itself the axial velocity profile has a pronounced maximum on the axis so that a flashback of the flame from the combustion chamber is not possible. However, it is correct to say that this axial velocity decreases toward the wall in such a configuration. So that flashback is also prevented in this area, the mixing tube 220 is provided in the flow and peripheral directions with a number of regularly or irregularly distributed bores 21 having the most varied cross-sections and directions. Through the bores 21 an air quantity flows into the interior of the mixing tube 220, and an increase in the velocity is induced along the wall. Another possibility of achieving the same effect is for the cross-section of flow of the mixing tube 220 on the outflow side of the transition passages 201, which form the transition geometry already mentioned, to undergo a convergence, as a result of which the entire velocity level inside the mixing tube 220 is raised. In the figure, the outlet of the transition passages 201 corresponds to the narrowest cross-section of flow of the mixing tube 220. The transition passages 201 accordingly bridge the respective difference in cross-section without at the same time adversely affecting the flow formed. If the measure selected for directing the tube flow 40 along the mixing tube 220 initiates an intolerable pressure loss, this can be remedied by a diffuser (not shown in the figure) being provided at the end of the mixing tube. A combustion chamber 30 adjoins the end of the mixing tube 220, there being a jump in cross-section between the two cross-sections of flow. Only here does a central backflow zone 50 form, which has the properties of a flame retention baffle. If a fluidic marginal zone forms inside this jump in cross-section during operation, in which marginal zone vortex separations arise due to the vacuum prevailing there, this leads to intensified ring stabilization of the backflow zone 50. At the end face, the combustion chamber 30 has a number of openings 31 through which an air quantity flows directly into the jump in cross-section and contributes there, inter alia, to the ring stabilization of the backflow zone 50 being intensified. In addition, it must not be left unmentioned that the generation of a stable backflow zone 50 also requires a sufficiently high swirl number in a tube. If such a high swirl number is undesirable in the first place, stable backflow zones can be generated by the feed of small, intensely swirled air flows at the tube end., for example through tangential openings. It is assumed here that the air quantity required for this is approximately 5–20% of the total air quantity.

Figure 2:
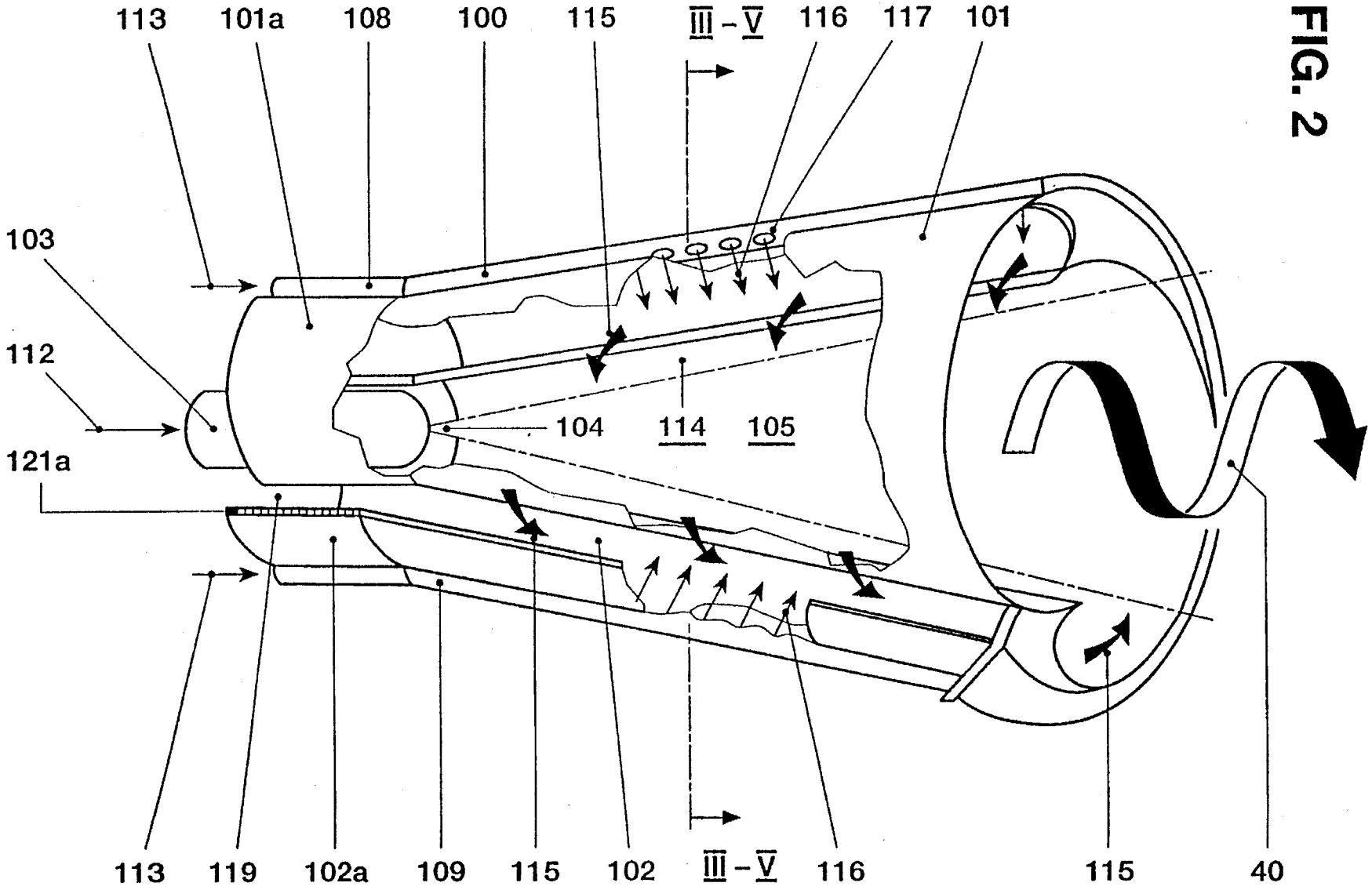
FIG. 2 shows a swirl generator in perspective representation, in appropriate cut-away section.
Figure 3:
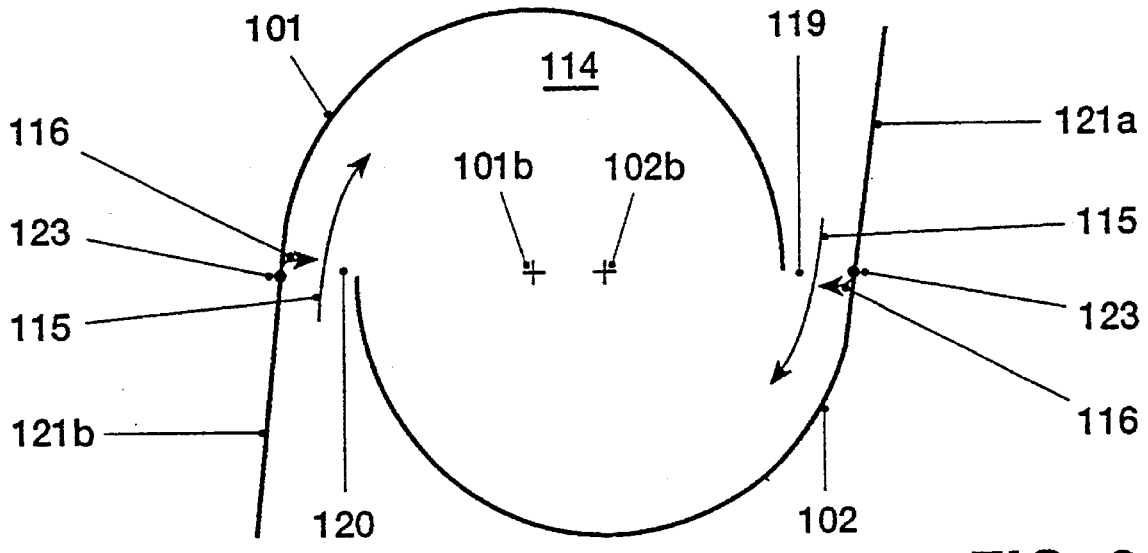
FIG. 3 shows a section through the two-shell swirl generator according to FIG. 2.

In order to better understand the construction of the swirl generator 100, it is of advantage if at least FIG. 3 is used at the same time as FIG. 2. Furthermore, so that this FIG. 2 is not made unnecessarily complex, the baffle plates 121*a*, 121*b* shown schematically according to FIG. 3 are only alluded to in FIG. 2. In the description of FIG. 2, the said figures are referred to below when required.

Figure 4:
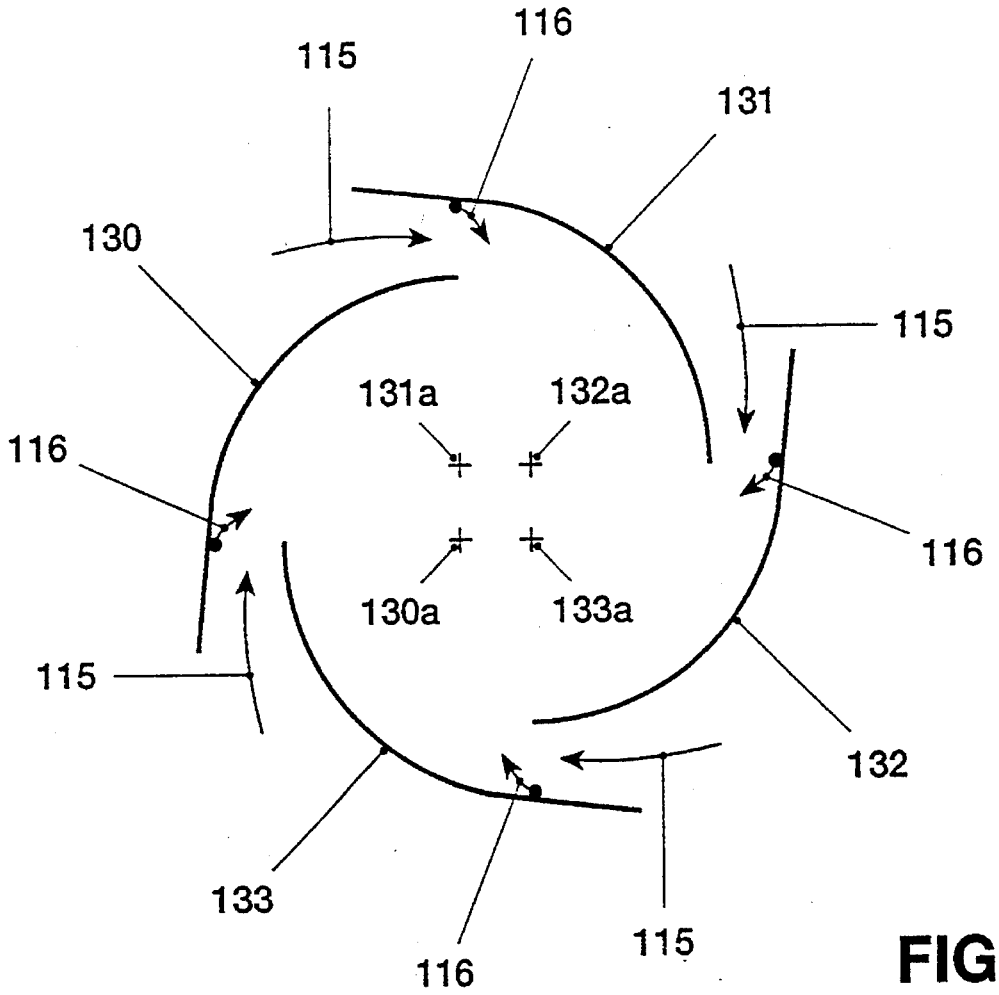
FIG. 4 shows a section through a four-shell swirl generator.
Figure 5:
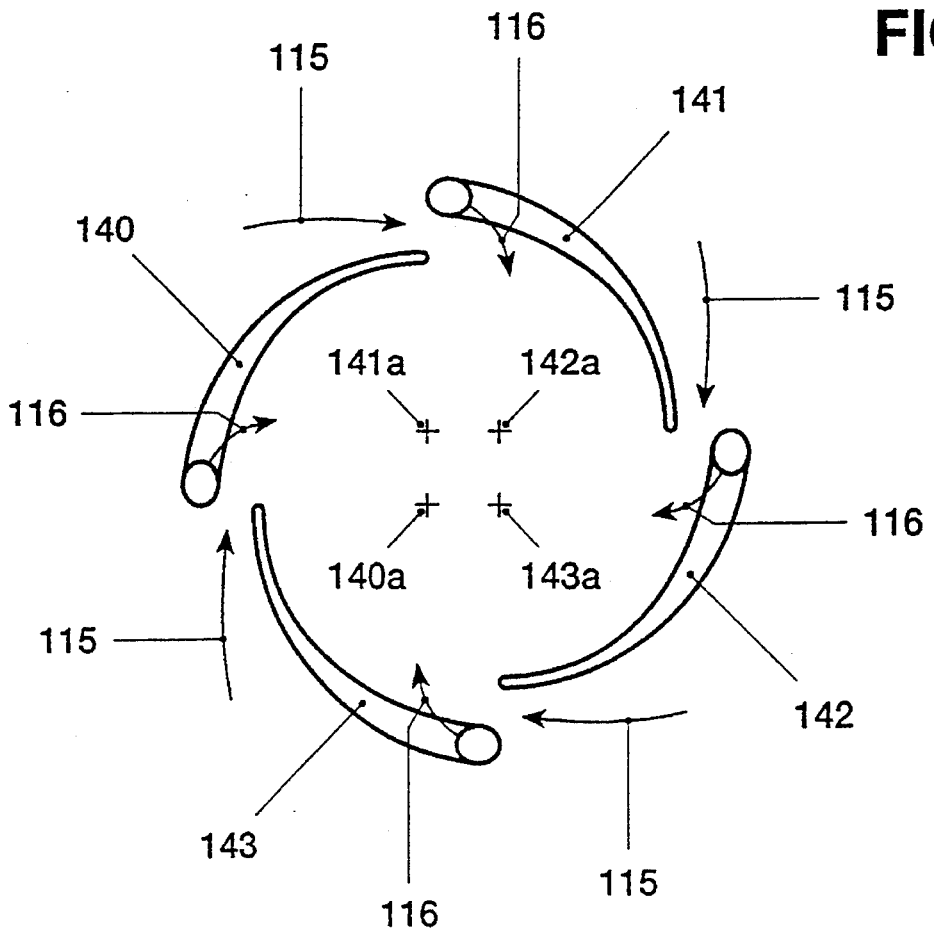
FIG. 5 shows a section through a swirl generator whose shells are profiled in a blade shape.

The first part of the burner according to FIG. 1 forms the swirl generator 100 shown according to FIG. 2. The swirl generator 100 consists of two hollow conical sectional bodies 101, 102 which are nested one inside the other to define a conical interior space, and with their respsective longitudinal axes of symmetry mutually offset to provide longitudinal slots between adjacent wall portions. The number of conical sectional bodies can of course be greater than two, as shown in FIGS. 4 and 5; this depends in each case on the mode of operation of the entire burner, as will be explained in more detail further below. It is not out of the question in certain operating conditions to provide a swirl generator consisting of a single spiral. The mutual offset of the respective center axis or longitudinal symmetry axes 201*b*, 202*b* of the conical sectional bodies 101, 102 provides at the adjacent wall portions, in mirror-image arrangement, one tangential duct each, i.e. an air-inlet slot 119, 120 (FIG. 3) through which combustion air 115 flows into the interior space of the swirl generator 100, i.e. into the conical hollow space 114. The conical shape of the sectional bodies 101, 102 shown has a certain fixed angle in the direction of flow. Of course, depending on the operational use, the sectional bodies 101, 102 can have increasing or decreasing conicity in the direction of flow, similar to a trumpet or tulip respectively. The two last-mentioned shapes are not shown graphically, since they can readily be visualized by a person skilled in the art. The two conical sectional bodies 101, 102 each have a cylindrical initial part 101*a*, 102*a*, which likewise run offset from one another in a manner analogous to the conical sectional bodies 101, 102 so that the tangential air-inlet slots 119, 120 are present over the entire length of the swirl generator 100. Accommodated in the region of the cylindrical initial part is a nozzle 103, preferably for a liquid fuel 112, the injection point 104 of which coincides approximately with the narrowest cross-section of the conical hollow space 114 formed by the conical sectional bodies 101, 102. The injection capacity of this nozzle 103 and its type depend on the predetermined parameters of the respective burner. It is of course possible for the swirl generator 100 to be embodied purely conically, that is, without cylindrical initial parts 101*a*, 102*a*. Furthermore, the conical sectional bodies 101, 102 each have a fuel line 108, 109 and are arranged along the tangential air-inlet slots 119, 120 and which are provided with injection openings 117 through which preferably a gaseous fuel 113 is injected into the combustion air 115 flowing through there, as the arrows 116 are intended to symbolize. These fuel lines 108, 109 are preferably positioned at the end of the tangential inflow, before entering the conical hollow space 114, in order to obtain optimum air/fuel mixing. As mentioned, the fuel 112 fed through the nozzle 103 is a liquid fuel 112 in the normal case, a mixture formation with another medium being readily possible. This fuel 112 is injected at an acute angle into the conical hollow space 114. Thus a conical fuel spray 105 forms from the nozzle 103, which fuel spray 105 is enclosed by the rotating combustion air 115 flowing in tangentially. The concentration of the injected fuel 112 is continuously reduced in the axial direction by the inflowing combustion air 115 for mixing in the direction of vaporization. If a gaseous fuel 113 is injected via the opening nozzles 117, the fuel/air mixture is formed directly at the end of the air-inlet slots 119, 120. If the combustion air 115 is additionally preheated or enriched, for example, with recycled flue gas or exhaust gas, this provides lasting assistance for the vaporization of the liquid fuel 112 before this mixture flows into the downstream stage. The same considerations also apply if liquid fuels are to be supplied via the lines 108, 109. Narrow limits per se are to be adhered to in the configuration of the conical sectional bodies 101, 102 with regard to the cone angle and the width of the tangential air-inlet slots 119, 120 so that the desired flow field of the combustion air 115 can develop at the outlet of the swirl generator 100. In general it may be said that a reduction in the tangential air-inlet slots 119, 120 promotes the quicker formation of a backflow zone already in the region of the swirl generator. The axial velocity inside the swirl generator 100 can be changed by a corresponding feed (not shown) of an axial combustion-air flow. Corresponding swirl generation prevents the formation of flow separations inside the mixing tube arranged downstream of the swirl generator 100. Furthermore, the construction of the swirl generator 100 is especially suitable for changing the size of the tangential air-inlet slots 119, 120, whereby a relatively large operational range can be covered without changing the overall length of the swirl generator 100. The sectional bodies 101, 102 can of course also be displaced relative to one another in another plane, as a result of which even an overlap of the same can be provided. Furthermore, it is possible to nest the sectional bodies 101, 102 spirally one inside the other by a contra-rotating movement. It is thus possible to vary the shape, size and configuration of the tangential air-inlet slots 119, 120 as desired, whereby the swirl generator 100 can be used universally without changing its overall length.

The geometric configuration of the baffle plates 121*a*, 121*b* is now apparent from FIG. 3. They have a flow-initiating function, in which case, in accordance with their length, they extend the respective end of the conical sectional bodies 101, 102 in the oncoming-flow direction relative to the combustion air 115. The channeling of the combustion air 115 into the conical hollow space 114 can be optimized by opening or closing the baffle plates 121*a*, 121*b* about a pivot 123 placed in the region of the inlet of this duct into the conical hollow space 114, and this is especially necessary if the original gap size of the tangential air-inlet slots 119, 120 is to be changed dynamically. These dynamic measures can of course also be provided statically by baffle plates forming as and when required a fixed integral part with the conical sectional bodies 101, 102. The swirl generator 100 can likewise also be operated without baffle plates or other aids can be provided for this.

FIG. 4, in comparison with FIG. 3, shows the swirl generator composed of four sectional bodies 130, 131, 132, 133. The associated longitudinal symmetry axes for each sectional body are identified by the letter a. Of this configuration it may be said that, on account of the smaller swirl intensity thus produced and in interaction with a correspondingly increased slot width, it is best suited for preventing the breakdown of the vortex flow on the downstream side of the swirl generator in the mixing tube, whereby the mixing tube can best fulfill the role intended for it.

FIG. 5 differs from FIG. 4 inasmuch as the sectional bodies 140, 141, 142, 143 here have a bladeprofile shape which is provided for supplying a certain flow. Otherwise, the mode of operation of the swirl generator is kept the same. The admixing of the fuel 116 with the combustion-air flow 115 is effected from the interior of the blade profiles, i.e. the fuel line 108 is now integrated in the individual blades. Here, too, the longitudinal symmetry axes for the individual sectional bodies are identified by the letter a.

Figure 6:
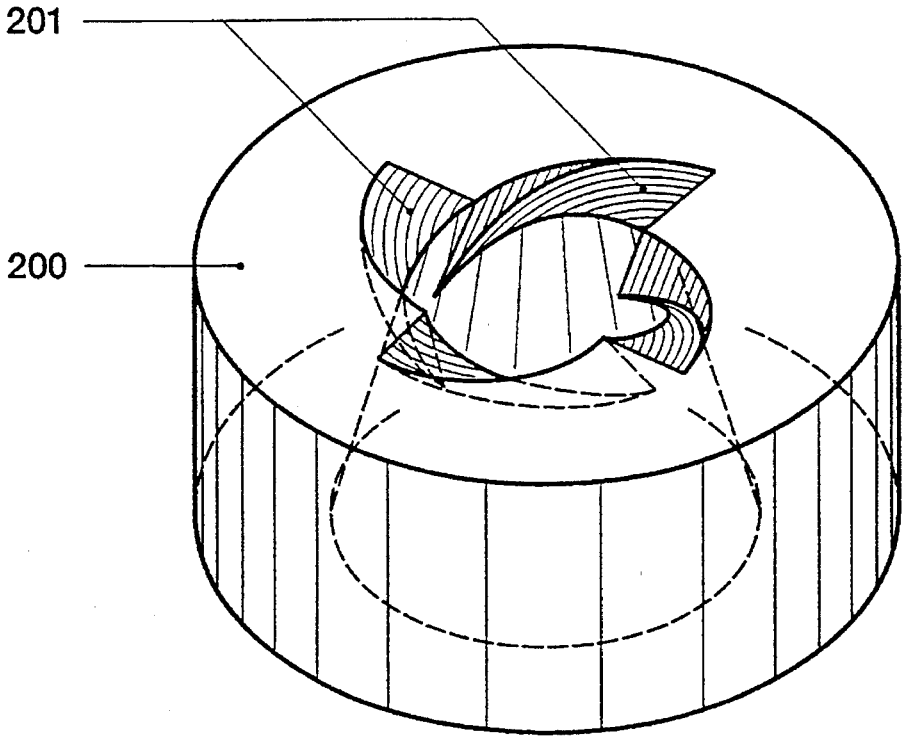
FIG. 6 shows a perspective view of the transition geometry between swirl generator and mixing tube.

FIG. 6 shows the transition piece 200 in a perspective view. The transition geometry is constructed for a swirl generator 100 having four sectional bodies in accordance with FIG. 4 or 5. Accordingly, the transition geometry has four transition passages 201 as a natural extension of the sectional bodies acting upstream, as a result of which the cone quadrant of the said sectional bodies is extended until it intersects the wall of the tube 20 or the mixing tube 220 respectively. The same considerations also apply when the swirl generator is constructed from a principle other than that described under FIG. 2. The surface of the individual transition passages 201 which runs downward in the direction of flow has a form which runs spirally in the direction of flow and describes a crescent-shaped path, in accordance with the fact that in the present case the cross-section of flow of the transition piece 200 widens conically in the direction of flow. The swirl angle of the transition passages 201 in the direction of flow is selected in such a way that a sufficiently large section subsequently still remains for the tube flow up to the jump in cross-section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial-velocity profile towards the center of the mixing tube, so that the risk of premature ignition is decisively counteracted.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A burner for a heat generator, the burner having a direction of flow, comprising:

a swirl generator for introducing a swirled combustion air flow into the burner;

means for injecting fuel into the combustion air flow in the swirl generator;

a mixing section connected at a downstream end of the swirl generator to receive the combustion air flow and fuel; and transition means between the swirl generator and the mixing section including transition passages to guide the swirled combustion air flow and injected fuel from the swirl generator into the mixing section.

2. The burner as claimed in claim 1, wherein the mixing section is a tubular mixing element.

3. The burner as claimed in claim 1, wherein the swirl generator is formed of at least two sectional bodies defining an interior space, and the transition passages in the mixing section correspond in quantity to the sectional bodies forming the swirl generator.

4. The burner as claimed in claim 1, wherein a portion of the mixing section downstream of the transition passages includes openings along the direction of flow and about a periphery, the openings acting as prefilming bores for injecting an air flow into the mixing section.

5. The burner as claimed in claim 1, wherein a portion of the mixing section downstream of the transition passages includes tangential openings for an air flow into the mixing section.

6. The burner as claimed in claim 1, wherein a cross-section flow area of the mixing section downstream of the transition passages is less than a cross-section flow area in the swirl generator.

7. The burner as claimed in claim 1, wherein the transition passages open into an upstream end face of the mixing section and are oriented helically in the direction of flow.

8. The burner as claimed in claim 1, further comprising a diffuser disposed at a downstream end of the mixing section.

9. The burner as claimed in claim 1, further comprising a combustion chamber connected downstream of the mixing section, wherein an upstream end factor the combustion chamber defines a radially increasing jump in cross-section between the mixing section and the combustion chamber, which jump in cross-section defines an initial cross-section of flow of the combustion chamber, and defines a region in the combustion chamber wherein a backflow zone is formable.

10. The burner as claimed in claim 1, wherein the swirl generator comprises at least two hollow, conical sectional bodies nested one inside the other and aligned in the direction of flow to form a conical interior space, respective longitudinal symmetry axes of the sectional bodies being mutually offset so that adjacent walls of the sectional bodies form longitudinally extending ducts for a tangentialy directed combustion-air flow into the interior space, and wherein the means for injecting fuel comprises at least one fuel nozzle disposed for injecting fuel in the conical interior space.

11. The burner as claimed in claim 10, further comprising fuel nozzles arranged in a region of the longitudinally extending ducts in the longitudinal extent to inject fuel into the tangentially directed flow.

12. The burner as claimed in claim 10, wherein each of the sectional bodies has a blade-shaped profile in cross-section.

13. The burner as claimed in claim 10, wherein the sectional bodies have a fixed cone angle in the direction of flow.

14. The burner as claimed in claim 10, wherein the sectional bodies are nested spirally one inside the other.

15. The burner as claimed in claim 10, wherein the sectional bodies are shaped to have a cone angle that increases in the direction of flow.

16. The burner as claimed in claim 10, wherein the sectional bodies are shaped to have a cone angle that decreases in the direction of flow.

17. The burner as claimed in claim 1, wherein a cross-section flow area of the mixing section downstream of the transition passages is at least equal to a cross-section flow area in the swirl generator.

18. The burner as claimed in claim 1, wherein the transition passages are formed as recesses in a wall of the transition means which communicate with the swirl generator.

* * * * *